United States Patent [19]

Waddell et al.

[11] Patent Number: 4,967,772

[45] Date of Patent: Nov. 6, 1990

[54] TOBACCO SMOKING ARTICLE AND TREATMENT OF TOBACCO SMOKE WITH AT LEAST ONE ALCOHOL

[75] Inventors: William J. Waddell; Carolyn Marlowe, both of Prospect; L. Douglas Keeney, Louisville, all of Ky.

[73] Assignee: C.A. Blockers, Inc., Petersburg, Va.

[21] Appl. No.: 84,798

[22] Filed: Aug. 13, 1987

[51] Int. Cl.[5] ..... A24B 15/30

[52] U.S. Cl. ..... 131/334; 131/335; 131/337; 131/309; 131/310; 131/352; 131/31

[58] Field of Search ..... 131/334, 337, 31, 309, 131/352, 310, 335

[56] References Cited

U.S. PATENT DOCUMENTS

| | | | |
|---|---|---|---|
| 687,308 | 11/1901 | Hawkins . | |
| 937,801 | 10/1909 | Heddles . | |
| 1,920,588 | 8/1933 | Pacini . | |
| 3,339,558 | 9/1967 | Waterbury . | |
| 3,547,130 | 12/1970 | Harlow et al. . | |
| 3,817,258 | 6/1974 | Ernow . | |
| 3,854,487 | 12/1974 | Molins et al. . | |
| 3,884,246 | 5/1975 | Walker | 131/337 |
| 4,022,224 | 5/1977 | Saifer et al. . | |
| 4,236,532 | 12/1980 | Schweizer . | |
| 4,449,541 | 5/1984 | Mays et al. . | |
| 4,516,588 | 5/1985 | Rudolph et al. . | |
| 4,617,945 | 10/1986 | Vos et al. . | |

FOREIGN PATENT DOCUMENTS

| | | | |
|---|---|---|---|
| 55-79319 | of 0000 | Japan . | |
| 1204018 | 9/1970 | United Kingdom | 131/337 |

OTHER PUBLICATIONS

"Inhibition by Alcohols of the Localization of Radioactive Nitrosonornicotine in Sites of Tumor Formation", by William J. Waddell, M.D., and Carolyn Marlow, Science, vol. 221, pp. 51–53, Jul. 1, 1983.

"An Index of Tumor Chemotherapy", by Helen M. Dyer, National Cancer Institute, Mar. 1949.

"Tobacco Flavoring For Smoking Products", by Leffingwell et al., Published 1972 by R. J. Reynolds Tobacco Co., Copy found in Art Unit 332, pp. 16–19 cited.

*Primary Examiner*—V. Millin

*Attorney, Agent, or Firm*—Banner, Birch, McKie & Beckett

[57] ABSTRACT

A tobacco smoking article including smoking tobacco held in a container and an alcohol supported by the container. The alcohol has two or more carbon atoms and is capable when the vapor thereof is inhaled by the smoker of inhibiting the selective localization of nitrosamines and metabolites thereof in the smoker's tissues, such as those of the bronchial epithelium. The alcohol is associated with the smoking tobacco such that, when the tobacco is smoked, the vapors of the alcohol are inhaled in the tobacco smoke stream. The alcohol is present in an amount sufficient to inhibit the selective localization but not to produce any toxic side effects in the smoker.

76 Claims, 4 Drawing Sheets

TOBACCO SMOKING ARTICLE AND TREATMENT OF TOBACCO SMOKE WITH AT LEAST ONE ALCOHOL

BACKGROUND OF THE INVENTION

This is a continuation-in-part of copending application Ser. No. 921,823, filed Oct. 21, 1986, now abandoned which is a continuation of Ser. No. 834,129 filed Feb. 26, 1986, now abandoned, which in turn is a continuation of Ser. No. 506,824, filed June 23, 1983, now abandoned, whose entire contents are hereby incorporated by reference.

This invention relates to tobacco smoking articles and their construction, and also to methods for reducing the health risks of smokers.

It is known that tobacco and, more particularly, tobacco smoke contain numerous potential carcinogens and cocarcinogens. *Accounts of Chem. Res.*, S. Hecht et al, 12: 92–98 (1979). *Cancer Research*, D. McCoy et al, 41, 2849–2854 (1981). Some of these potential carcinogens and cocarcinogens are tobacco specific; that is, they are associated with and are introduced only by the use of tobacco. It is also known that N'-Nitrosonoronicotine (NNN) is one of the major tobacco-specific carcinogens occurring in tobacco and also in the particulate phase of tobacco smoke. *N-Nitroso Compounds in the Environment: IARC Scientific Publication.* No. 9, pp. 159–165, D. Hoffmann et al (1975). See also, *Studies on the Reduction of Nitrosamines in Tobacco*, W.J. Chamberlain et al, Tobacco Science 81 (1981). ("It is known that N-nitroso derivatives of tobacco alkaloids, such as N,nitrosornicotine (NNN) and 4-N-methyl-N-nitrosamino)-1-(3-pyridyo-1-butano (NNK) are powerful environmental carcinogens.").

Other related nitrosamines such as N-Nitrosopyrrolidine (NPYR) are found in cooked bacon and other processed meats, as well as in tobacco and tobacco smoke. *IARC Science Publication*, D. Harvery et al, 17: 313 (1978). Hence, nitrosamines can arrive in the environment from several sources.

Recent experimentations with NNN have left little doubt that this compound is likely to be a potent carcinogen or precarcinogen in mammals. By administering NNN in drinking water, esophageal tumors have been induced in F-344 rats. *Carcinogenesis.* S. Hecht et al, 3: 453–456 (1982). Further, administration of NNN is also known to induce carcinogenesis in the olfactory epithelium, lung, salivary glands of rodents. See *Cancer Research*, W. Waddell et al, 40: 3518–3523 (1980). Moreover, the presence of a metabolite of NNN at the sites of tumor formation has been confirmed by radio labelling experiments. A whole-body autoradiography study of adult male C57BL/6J mice, utilizing [$^{14}$C] NNN to assess the specific distribution of NNN and its metabolites in all the tissues of the body, revealed a striking correlation of the retention of radioactivity with the previously reported sites of tumor formation *Cancer Research*, W. Waddell et al, 40: 3518–3523 (1980).

It has interestingly been discovered that NNN exhibits an extraordinary degree of selection in inducing tumor formation. That is, NNN typically induces tumor formation at five sites, namely the nasal cavity, salivary duct, esophagus, bronchial epithelium and the liver, *Cancer Research, supra.* While the precise method of NNN carcinogenesis is unclear, there is evidence that the proximal carcinogen is formed following the a -hydroxylation of NNN in vivo. *Cancer Research*, C. Chen et al, 38: 3639–3645 (1978). *Cancer Research*, W. Waddell et al, 40: 3518–3523 (1980). Experimentation has indicated, for example, that the F-344 rat esophagus, in contrast to other tissues, preferentially catalyzes hydroxylation at the a-carbon of NNN adjacent to the pyridine ring. *Carcinogenesis*, S. Hecht et al, 3: 453–456 (1982). Thus, the selective retention of NNN and metabolites thereof in sites where tumor formations are known to occur preferentially allows an excellent correlation of molecular accumulation with carcinogenic activity. However, despite the increasingly strong nexus between the tumor incidence, reactive nitrosamines such as NNN continue to be ubiquitous in the environment, especially including in the tobacco smoke stream.

A number of proposals have been made to reduce the amount of such substances inhaled by the smoker in the smoke stream. Generally, these proposals fall into three categories. The first category pertains to methods for reducing the irritant material itself, generally through changes in tobacco blends, by special growing, processing or extraction, by the partial or total replacement of the tobacco with tobacco substitutes, or by varying the tobacco's combustion temperatures. The second category is concerned with the dilution of the smoke before it enters the smoker's mouth, as for example by the use of highly permeable cigarette paper or filter paper or by the perforation of the cigarette filter to allow air to be drawn directly into the smoke stream. The third category of proposals deals with the construction of the filter itself to achieve the high filtration or the selective removal of particulate matter.

While many of these proposals, individually or in combination have been successfully commercialized, each reduction of the tar and nicotine yield and of irritating substances is accompanied by a corresponding reduced level of the resulting smoker satisfaction. Further, although many substances have been isolated as carcinogenic, gross reduction of tar and nicotine yields and gross reduction of irritating substances does not selectively reduce the isolated carcinogen because these proposals do not selectively or effectively isolate these carcinogens. Recent sales data indicate that, despite various products purporting unique methods of maintaining taste satisfaction at reduced levels of tar and nicotine and irritant deliveries, sales of lowered tar and nicotine and irritant products, particularly those commercially classified as "ultra low tar and nicotine" products, are decreasing. Further in accordance with the preceding, the practical deficiency of products purporting to selectively or grossly remove substantially all of an isolated carcinogenic material is evidenced by recent data which indicates that long-term cancer incidences have not, as one would have expected from the adoption of such products, been reduced but, rather, have increased. Additionally, no known cigarette or cigarette filter designs preferentially reduces or filters out any chemical compound, in particular, any carcinogen. Known cigarettes and cigarette filters also do not discriminate as to particulate matter or carcinogens.

Clearly then, the practice of reducing either tar and nicotine and irritant content or reducing specific carcinogenic matter content is severely limited in terms of the efficacy thereof for reducing irritants to which a smoker is exposed or for reducing the smoker's continued exposure to the health risks associated with carcinogenic matter found in the smoke stream. This is evidenced by the smoker's dissatisfaction with ultra low levels of tar and nicotines due to unacceptable low taste satisfaction. It is further accepted that mere gross reductions in smoke stream constituents at the very least fails to reduce the isolated carcinogens below a concentration in the smoke stream that would be non-toxic, and, in the case of eliminating isolated carcinogens, is a deficient course of action.

OBJECTS AND SUMMARY OF THE INVENTION

Accordingly, it is a primary object of the present invention to provide a novel cigarette construction which does not adversely effect or detract from the smoking satisfaction but does reduce some associated health concerns and risks.

Another object of the present invention is to provide a novel smoking tobacco product which does not require the smoker to vary his normal smoking regime and which does not compromise the structure of the cigarette over the normal course of the manufacture, distribution, storage and handling of it.

A further object of the present invention is to provide a tobacco product or article which inhibits in a non-toxic manner the selective localization of nitrosamines and metabolites thereof in the smoker's tissues.

A still further object is to provide for the addition of a substance to a tobacco smoking product which reduces the smoker's health risks from exposure to the tobacco smoke but does not require any varied manipulation of the product as it is being smoked.

Another object is to provide a novel cigarette construction which provides for the blocking of the localization of NNN and can be manufactured according to current high speed rates of production of about 1,000–8,000 cigarettes per minute.

A further object is to provide a novel method for inhibiting the selective localization of nitrosamines and metabolites thereof from tobacco smoke in the tissues of a smoker (or those around him), and more particularly NNN and metabolites thereof.

A still further object is to provide a novel tobacco smoking article which does not reduce the presence of any substance in the smoke stream or require a reduction in the tars and nicotines and irritants therein, but reduces the smoker's health risk.

Another object is to provide a cigarette having a unique cigarette additive which is invisible to the eye and does not change the size, shape and feel of the cigarette, and thereby increases the likelihood that the cigarette will be purchased and smoked.

A novel application of a blocking agent is proposed by this invention that has the effect of neutralizing this tobacco-specific carcinogen without the problem of taste unacceptability associated with previous efforts to isolate and specifically remove carcinogenic compounds through reductions of smoke stream tars, nicotines, and irritants. This invention discloses a means of selectively isolating this carcinogen in the smoke stream and to block the biological activity of this carcinogen in the identified organs of the smoker's body. Rather than a reduction of any element in the smoke stream, the introduction of a blocking agent in the smoke stream is called for herein. Remarkably, this blocking agent appears to be active only when in contact with the specific cell-receptors on or in the identified organs of the smoker's body. Since there is no need for any reduction of the tar and nicotine content of the particular brand of cigarette smoked, there would be no associated reduction in smoker taste satisfaction.

Other objects and advantages of the present invention will become apparent to those persons having ordinary skill in the art to which the present invention pertains from the foregoing description taken in conjunction with the accompanying drawings.

GENERAL DISCUSSION OF THE INVENTION

Figure 1:
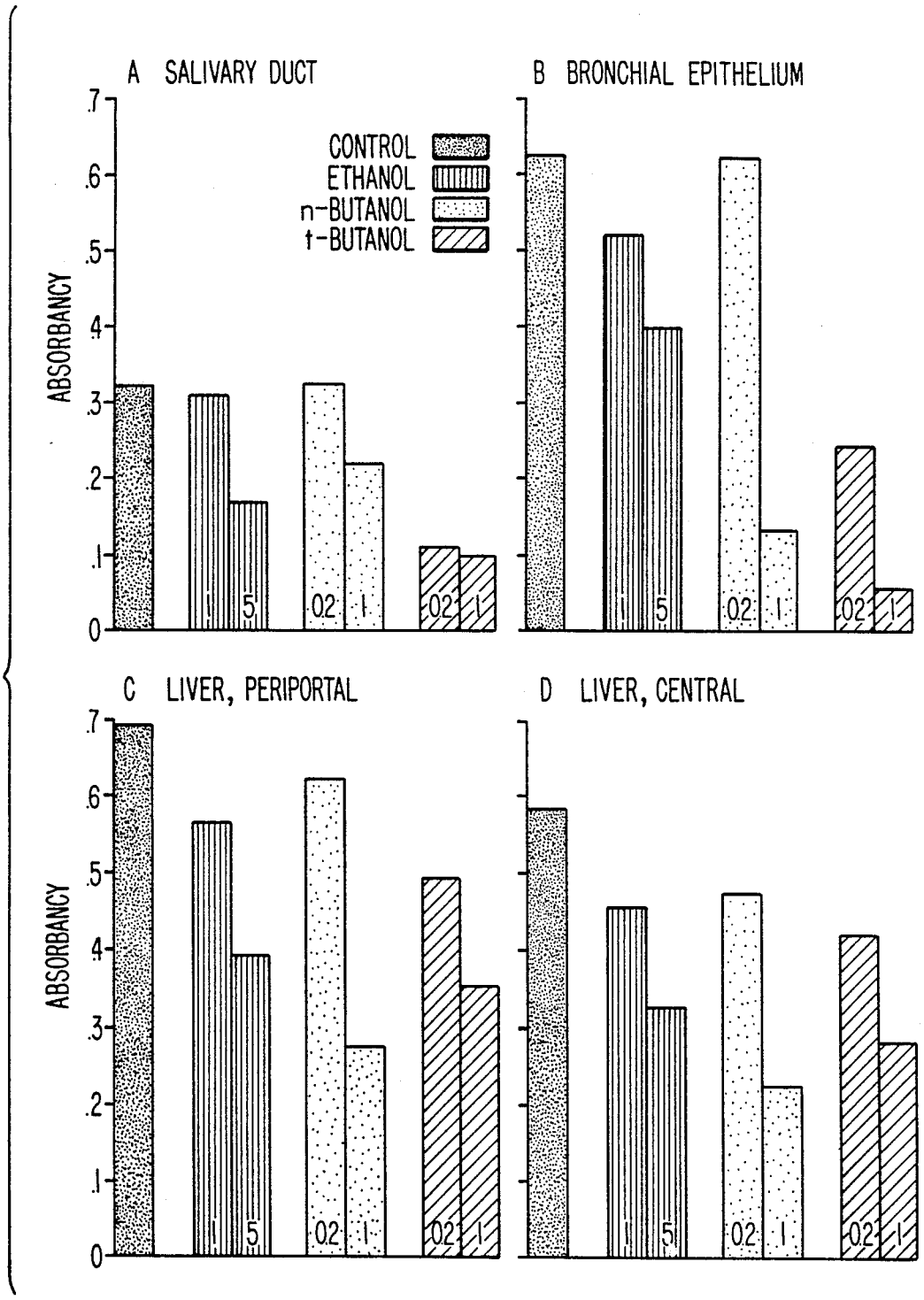
FIG. 1 is a bar graph representation of inhibition test results for the present invention.

According to the present invention, a tobacco smoking product or article has been discovered whereby the selective localization of nitrosamines such as NNN and metabolites thereof in at least three of the mammalian tissues in which these compounds are known to accumulate is inhibited by additives in the smoke stream. These tissues are the bronchial epithelium, the salivary duct epithelium and the liver, and not coincidentally, these are the same mammalian tissues in which nitrosamines such as NNN and metabolites thereof appear to function as carcinogens.

NNN is one of the most abundant carcinogens found in cigarette smoke and cancerous tumors form where NNN accumulates such as in the lung. While the actual biochemical process involved herein has not yet been determined, the NNN alcohol blockers of this invention are thought to work in one of the following ways: either the alcohol molecules bind with surface cell receptors of the tissue cells at the sites of localization of NNN, such as in the lung, liver and salivary duct, thereby preventing the binding of NNN and its carcinogenic metabolites; or, alternatively, the alcohol molecules bind with cell receptors within the tissue cells at these sites, either blocking or altering the process by which NNN is metabolized within the cell and thereby preventing the formation of the carcinogenic metabolites of NNN. In other words, the alcohol molecules have the effect of either "jamming the lock (the cell receptor)" and preventing the "NNN key (molecule)" from entering, or altering the "NNN key" so that it will no longer fit in the "lock". Unable to dock in the tissue, the NNN then passes harmlessly out of the lung.

The present invention then is directed to methods for inhibiting the selective localization of nitrosamines and metabolites thereof in mammalian tissues, and not to the treatment of tumors. In other words, the subject invention is not directed to the treatment of tumors or cancer but rather is concerned with delocalizing nitrosamines and metabolites thereof, i.e., chemicals, which tend to selectively localize in mammalian tissue. In fact, the tobacco smoking products or articles of the present invention can be effective even where tumors are not present.

Surprisingly, it has been discovered that certain alcohols inhibit this selective localization of nitrosamines such as NNN and metabolites thereof. The alcohols which are operable according to the invention include alcohols having two or more carbons. However, it is preferable to use alcohols having alkyl groups of at least three carbons or greater. The alkyl groups may have a straight-chain or branched chain structure. Moreover, the alkyl groups may have a cyclic or acyclic structure. Examples of alcohols which may be used are ethanol, n-propanol, isopropanol, n-butanol, sec-butanol, isobutanol, t-butanol, 2-methyl-1-butanol or "active" amyl alcohol, n-amyl alcohol, secamyl alcohol, t-amyl alcohol, n-hexyl alcohol and cyclohexanol. Other chemical compounds which have also been found to delocalize nitrosamines are dimethylsulfoxide (DMSO), imidazole, pyrazole, diethyldithiocarbamate, and benzylisothiocyanate. These and other alcohols and compounds of the present invention are listed below in Table I. A preferred alcohol of this list when delivered in the tobacco smoke stream are the cyclohexanols as they add little taste to the smoke and have a pleasant odor. It has been specifically noted that the alcohol retinol does and retinol does not inhibit nitrosamine localization as do the compounds encompassed by this invention.

TABLE I

The patent application covers all monohydric and polyhydric alcohols and compounds with a resonant hydroxyl species of from two to forty carbon atoms including, but not limited to, the following:

| MONOHYDRIC ALCOHOLS: | POLYHYDRIC ALCOHOL: |
|---|---|
| Ethyl alcohol | Ethylene glycol |
| n-Propyl alcohol | 1,2-Propanediol |
| Isopropyl alcohol | 1,3-Propanediol (tri-methylene glycol) |
| Allyl alcohol | 1,3-Butanediol |
| Crotyl alcohol | 1,4-Butanediol |
| n-Butyl alcohol | 2,3-Butanediol |
| Isobutyl alcohol | 1,5-Pentanediol |
| sec-bUtyl alcohol | 1,6-Hexanediol |
| t-Butyl alcohol | 1,10-Decanediol |
| 2-pentanol | Pinacol |
| 3-pentanol | Glycerol |
| n-Amyl alcohol | 1,2,4,Butanetriol |
| Isoamyl alcohol | 1,2,6-Hexanetriol |
| t-Amyl alcohol | |
| 2-methyl-1-butanol | COMPOUNDS WITH RESONANT HYDROXYL SPECIES: |
| 3-methyl-2-butanol | |
| Neopentyl alcohol | Dimethyl-Sulfoxide (DMSO) |
| Cyclopentanol | |
| n-Hexyl alcohol | |
| 2-hexanol | |
| 3-hexanol | |
| 2-methyl-1-amyl | |
| 3-methyl-1-amyl | |
| Cyclohexanol | |
| n-Octyl alcohol | |
| Capryl alcohol | |
| n-Decyl alcohol | |
| Lauryl alcohol | |
| Myristyl alcohol | |

-continued

| MONOHYDRIC ALCOHOLS: | POLYHYDRIC ALCOHOL: |
|---|---|
| Cetyl alcohol | |
| Stearyl alcohol | |
| Benzyl alcohol | |
| Benzhydrol | |
| Cinnamyl alcohol | |
| Triphenylcarbinol | |

The amount of alcohol which is applied may be any amount which is greater than the threshold amount needed to effect nitrosamine delocalization in the affected mammalian tissues, but less than an amount which would produce any toxic side effects in the mammal. Generally, for oral administration of the alcohols of the present invention, about 1 ul of an alcohol is used per gram of mammalian body weight. The amounts of alcohols contemplated for use herein fall far short of the dosages required for toxic effects. Also, the higher alcohols are among the least toxic of commonly used chemicals and, in general, their toxic effects are reduced as the carbon chain length is increased. Table II below summarizes the toxicological properties of some typical alcohols. *Kirk-Othmer: Encyclopedia of Chemical Technology,* Vol. 1, at 727 (1978) and *The Registry of Toxic Effects of Chemical Substances,* U.S. Department of Health, Education and Welfare, Vol. 2 (1977).

TABLE II

| Alcohol | Acute Oral $LD_{50}$[a] rats g/kg |
|---|---|
| ethanol | 14 |
| n-propyl | 5.4 |
| isopropyl | 5.84 |
| n-butyl | 0.79 |
| isobutyl | 2.46 |
| t-butyl | 3.5 |
| n-amyl | 3.03 |
| sec-amyl | 1.47 |
| iso-amyl | 1.30 |
| t-amyl | 1.0 |
| hexyl[b] | 3.7 |
| cyclohexyl | 2.06 |
| "active"-amyl (e.g. 2-methyl-1-butanol) | 4.9 |
| retinol | 2.0 |
| menthol | 3.18 |
| 4-methyl-2-pentanol | 2.6 |
| 2-ethyl hexanol | 3.2–7.1 |
| isoctyl[b] | 1.5 |
| decyl[b] | 4.7–9.8 |
| dodecanol, 98% (coconut derived) | 40 |
| hexadecanol | 20 |
| octadecanol | 20 |

(a) The dose resulting in the death to 50% of the test animals, expressed in terms of g of materials per kg of body weight.
(b) mixed isomers.

The values for acute oral toxicity may be compared to an $LD_{50}$ of about 3.75 g/Kg for sodium chloride with rats. A substance with an $LD_{50}$ of 15 g/KG or above is generally considered to be nontoxic. By comparison, the estimated acutely fatal oral dose of nicotine, present in tobacco, for an adult human is 1 mg/kg of body weight. *Principles of Internal Medicine.* Harrison 9th Edit., Section 18 (1975). Thus, as the alcohols of the present invention are used in dilute aqueous solutions, one skilled in the art can easily achieve the desired delocalization effect of the present invention while avoiding the toxic side-effects of an overdose.

In addition to introducing potential carcinogens by smoking, smoking has also been linked with the depletion of certain B vitamins in the smoker. Furthermore, Vitamins C and E have been shown to prevent the formation of nitrosamines on epithelial membranes; in addition, Vitamin A and retinoids suppress malignant growth. Selenium and other agents also inhibit tumor development. (*Inhibition of Tumor Induction and Development;* N. S. Zedeck, M. Lipkin, Prenum Press, N.Y. 1981). Hence, it is within the scope of the present invention to combine the alcohols with various vitamins and other agents which are known to be depleted by smoking, to inhibit nitrosamine formation or to inhibit malignant growth and tumor development. Moreover, the amounts to be used of such vitamins or other agents such as Selinium would in view of the subject disclosure be within the knowledge and abilities of one skilled in the art. *Inhibition of Tumor Induction and Development,* supra, is incorporated herein in its entirety.

Examples of the present invention are now provided for purposes of clarity. However, it is understood that these examples are in no way intended to limit the scope of the present invention.

EXAMPLE 1

Adult male, C57BL/6J mice were injected intravenously with 0.12 to 0.19 Ci/g body weight, corresponding to a dose of 0.4 to 1.9 mg.Kg of [2'−$^{14}$C] NNN (New England Nuclear; Spec. Act. 18.4 or 51.7 mCi/mmol). One hour later, the mice were anesthetized lightly with ether and frozen by immersion in dry ice/hexane. Twenty u-thick whole-body sagittal sections of the frozen mice were taken onto Scotch tape and were then processed for whole-body autoradiography by known methods. See W. Waddell et al, *Drug Fate and Metabolism: Methods and Techniques.* E.R. Garrett and J.L. Hirtz, Eds. (Marcel Dekker, New York, 1977 at p 1–25). Photometric density in areas of the developed autoradiographs was measured with an ADG Instruments photometer and a photocell with an aperture of three mm lying on the easel of a photographic enlarger. The X-ray film was placed in the enlarger and raised to produce a magnification of thirty-five times on the easel.

Aqueous solutions of ethanol, n-butanol and t-butanol were administered by oral intubation to some of the mice twenty minutes before receiving the [$^{14}$C] NNN. Ethanol (1g/Kg and 5g/Kg) and n- and t- butanol (0.2 g/Kg and 1 g/Kg) solutions were prepared so that each mouse received 0.02 ml/g body weight. (Twenty minutes is the average time it takes for alcohols introduced by oral intubation in mice to reach the peak blood level.)

The autoradiographs revealed that the localization of radioactivity in salivary duct and bronchial epithelium and in both periportal and central areas of the liver was reduced by pretreatment with ethanol and to a greater extent with n-butanol. At the high dosage, t-butanol almost completely abolished the localization of [$^{14}$C] NNN in bronchial epithelium. Furthermore, the reduction in photometric density was dose related. FIG. 1 shows the absorbancies of the areas measured with the densitometer. Control experiments were conducted for comparison.

More particularly, FIG. 1 shows the means of the absorbancies from the photometric densitometer for the four areas in which inhibition of localization of radioactivity was seen. The number within each bar thereof represents the dose in g/kg of the alcohol which was administered orally twenty minutes before the [$^{14}$C] NNN was given intravenously. The mice were frozen one hour after receiving the [$^{14}$C] NNN. The means for each mouse were from fifteen measurements on random areas of that site (five absorbancies on each of three autoradiographs) after setting blood in each on zero. The control value is the mean from six mice; the n-butanol at one g/kg is from two mice; and the other means are from one mouse. The coefficient of variation of each mean was less than ten percent. All measurements were made at one occasion by the same observer who had no knowledge of the treatment of each randomly selected autoradiograph.

Further details and explanation of this example are set forth in the article authored by William J. Waddell, M.D. and Carolyn Marlowe, entitled "Inhibition of Alcohols of the Localization of Radioactive Nitrosonornicotine in Sites of Tumor Formation," *Science,* Vol. 221. pp. 51–53. July 1983, whose contents are hereby incorporated by reference in their entirety.

EXAMPLE 2

An adult C57BL/6J mouse was placed in a beaker with an elevated screen floor which had two ml of cyclohexanol beneath the floor on the bottom of the beaker, and the top of the beaker was then covered with foil. The mouse was kept in the closed beaker for about five minutes as the bottom of the beaker was maintained at 50° C. in a water bath. By referring to standard tables, it was calculated that at 50° C., the vapor pressure of cyclohexanol imparts an alcohol concentration of 0.01% in the air in the beaker. *Handbook of Chemistry and Physics* (1979) at D-203 to D-217, which is incorporated herein in its entirety.

After five minutes in the beaker, the mouse was injected intravenously with 0.12 to 0.19 Cu/g body weight, corresponding to a dose of 0.4 to 1.9 mg/kg of [$2^1$−$^{14}$C] NNN (New England Nuclear; Spec. Act. 18.4 or 51.7 mCi/Mmol). One hour later, the mouse was anesthetized lightly by ether and frozen by immersion in dry ice/hexane. Twenty u-thick whole-body, sagittal sections of the frozen mouse were taken onto Scotch tape and processed for whole-body autoradiography as in Example 1. No radioactivity was detected in any part of the bronchial epithelium. Control experiments were conducted for comparison purposes and radioactivity was detected in the respiratory epithelium in the controls.

EXAMPLE 3

Example 2 was duplicated, except that the mouse was kept in the closed beaker for five minutes as the bottom of the beaker was maintained at 20° C. in a water bath. By referring to standard tables, it was calculated that at 20° C., the vapor pressure of cyclohexanol imparts an alcohol concentration of 0.001% in the air in the beaker. After injection as in Example 2, the mouse was processed in the same manner as in Example 2. No radioactivity was detected in any part of the bronchial epithelium in contrast to the control experiment.

EXAMPLE 4

An adult male C57BL/6J mouse was injected intraperitoneally with 0.02 ml/g body weight of a solution of imidazole in water. The imidazole solution concentration was such that 0.05 g of imidazole was delivered per kg of body weight. Twenty minutes after injection, the mouse was injected intravenously with 0.12 to 1.9 Ci/g body weight, corresponding to a dose of 0.4 to 1.9 mg/kg of [2′ – $^{14}$C] NNN (New England Nuclear; Spec. Act 18.4 or 51.7 mCi/mmol). One hour later, the mouse was anesthetized lightly with ether and frozen by immersion in dry ice/hexane. Twenty u-thick whole-body, sagittal sections of the frozen mouse were taken onto Scotch tape which were then processed for whole-body autoradiography by known methods. See Example 1. Significant nitrosamine delocalization was discovered in the mouse injected with the imidazole solution relative to that in the control mouse.

EXAMPLE 5

Example 4 was duplicated except that the adult mouse was injected intraperitoneally with 0.02 ml/g body weight of a solution of imidazole in water, wherein the solution concentration was such that 0.25 g of imidazole was delivered per kg of body weight. After conducting the rest of the experiment as in Example 3, significant delocalization of nitrosamine was found in the mouse injected with the imidazole solution relative to that in a control mouse.

From inspection of FIG. 1, the greatest inhibition was observed with the t-butanol in bronchial epithelium. The reductions were similar in both areas of the liver for all three alcohols at the doses used. There were no significant differences between the control and treated groups in the absorbancies in nasal and esophageal epithelium. The results strongly suggest that pretreatment with alcohols inhibits the localization of the proximal carcinogen in bronchial and salivary duct epithelium and in liver, but not in nasal and esophageal epithelium in male, C57BL/6J mice. On a molar dose, t-butanol has approximately fifty times the potency of ethanol in inhibiting the localization in bronchial epithelium.

The specificity of inhibition in some sites but not others suggests that more than one mechanism is involved. One mechanism which may be involved is a competitive inhibition mechanism with either secondary alcohol dehydrogenase or cytochrome P-450$_{LM}$3a being involved. With either of these systems, it is thought that the alcohols of he present invention might compete successfully with the a-hydroxy NNN substrate to prevent the formation of the proximal carcinogen. While it is possible that a simple solvent effect may be involved, the site specificity and marked potency differences of the alcohols strongly favor metabolic inhibition. In any event, it is not necessary to restrict the present invention by basing the same on any particular theory.

In order to inhibit the selective localization of nitrosamines such as NNN and metabolites thereof, the alcohols of the present invention can be administered, by several different techniques. However, the means of application must be able to accomplish four objectives, namely, (1) delivery of the alcohol in high concentration only or primarily to desired sites of action, e.g., respiratory epithelium, (2) delivery only during the time interval of maximal exposure to the smoke, (3) delivery only or primarily to the smoker and (4) minimal exposure of other organs in the smoker's body to the inhibitory substance. The present invention is directed particularly to constructions of tobacco smoking products for delivering the alcohols in the tobacco smoke stream to the smoker and which fulfill these objectives.

DETAILED DESCRIPTION OF THE PREFERRED EMBODIMENTS

There are a variety of techniques by which these objectives may be satisfied while achieving nitrosamine delocalization. For example and generally speaking, the alcohols can be encapsulated in rupturable capsules filled with one or more alcohols of this invention and mixed with tobacco prior to smoking, as in a pipe, or the rupturable capsules may be placed directly in the tobacco or filter of a cigar or cigarette during the manufacture thereof. Alternatively, the rupturable capsules can be placed inside a disposable filter which can be placed on a cigar or cigarette, or a disposable smoke filter having a cylindrical body of plastic or paper which contains rupturable capsules containing one or more alcohols of the present invention can be provided. It is also within the scope of the invention to use any combination of the alcohol placement or fixation mechanisms mentioned or suggested herein within a single tobacco smoking article or product, e.g. cigarette.

Figure 2:
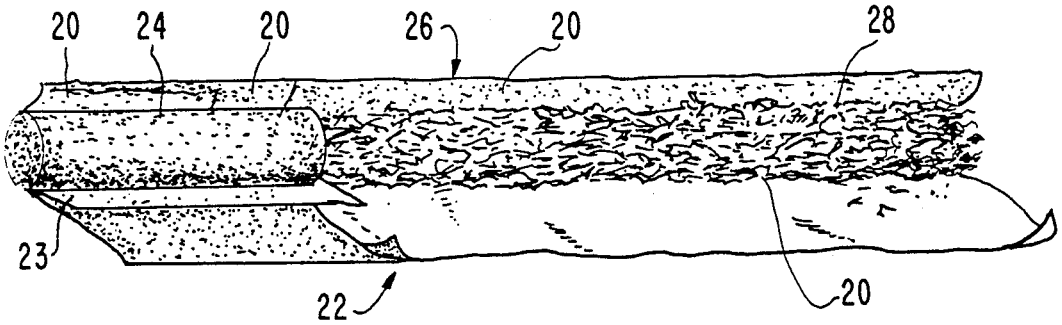
FIG. 2 is a perspective view of a first embodiment of the present invention.

One preferred construction for delivering these alcohols in the smoke stream of a tobacco article is to microencapsulate the alcohol and then to position the microcapsules within the article. It is noted that encapsulation initially isolates the alcohol and provides for the controlled release thereof so it can then interact with its smoke stream environment. The shell wall microencapsulation construction should be sufficiently compatible with the alcohol contained therein to retain the alcohol until such time as the heat of the smoke causes the shell to open. In other words, the microcapsule is stable within the cigarette and then is heat triggered and the alcohol therein controllably released. Encapsulation that melts, as opposed to volatizes, prevents the introduction into the smoke stream of vapors which are ordinarily a by-product of the volatilization of the shell wall. The alcohols are thereby automatically released for the convenience of the smoker so that he does not have to further manipulate the smoking product, and so to ensure a more consistent release. As shown in FIG. 2, these microencapsulated alcohols 20 can be placed in the cigarette shown generally at 22, the plug wrap 23, the acetate filter 24, in the cigarette tobacco rod 26 thereof mixed evenly into the cut rag tobacco 28 and/or in the filter 24. The dosage will be determined by the alcohol half life in the human such that sufficient alcohols are delivered to block the cell receptors with little waste or excess delivery. The dosage may also be varied according to the blend variables such as low tar blends, ultra low tars, full flavor blends, menthol blends, and blends of the various branded cigarettes.

A shell wall construction referred to as the M-CAP Process, of Insulation Technologies Corporation of Darby, Pennsylvania can be used. The general specification of the M-CAP shell walls are capsules as small as three microns with melt temperatures of sixty-four to six hundred and fifty degrees Fahrenheit. The rate of controlled release should generally be constant but it can be varied. More particularly, capsules with varied melt temperatures can be included in a single cigarette to ensure a constant release of the alcohols therein as the coal burns down the tobacco rod and the higher temperatures impact the filter section. Where the rate control is designed to vary, the shell material, thickness and/or capsule size can be varied. The M-CAP construction provides for uniform capsule size and for capsules smaller than fifty microns.

The encapsulation material of the shell wall can be ELVAX (ethylene/vinyl acetate copolymers) or a similar cellulite material having the desired characteristics of a programmable shell wall release temperature of between sixty-four and six hundred and fifty degrees Fahrenheit. ELVAX is an ethylene vinyl acetate resin, such as described in the "Material Safety Data Sheet - VAX001," dated 10/20/86, of E.I. DuPont de Nemours & Co. (Inc.) of Wilmington, Delaware. A second possible shell wall material is EUDRAGIT E, which is a cationic copolymer synthesized from dimethylaminoethyl metacrylate and neutral methacrylic acid ester, and can form a rapidly disintegrating film coating. Other shell well candidates include BERMOCOLL which is an ethylhydroryethylcellulose manufactured by Berol Kemi AB of Stenungsund, Sweden, and also K & K Gelatin, which is a gelatin manufactured by Kind & Knox, a division of Knox Gelatine, Inc., of Saddle Brook, N.J.

The shell wall should comprise between 20% and 50% of capsule volume for stability so as to resist rupture in the making, packing and consumer handling of the cigarette. The capsules should be three to ten microns in circumference when placed on the inside of the cigarette paper or if mixed into the tobacco so as to avoid undesired bumpiness on the cigarette paper and to remain invisible if placed in the tobacco. Larger circumferences up to fifty microns are acceptable if the capsules are placed in the cigarette filter. The capsules can be further hardened with a plasticizer to control their melt temperatures. Further, the capsules can be dyed with suitable food dyes to match the color of the cigarette tobacco. It is also within the scope of the present invention to assure further stability by double encapsulating the capsules, as for example by the M-CAP or coacervation processes.

Figure 3:
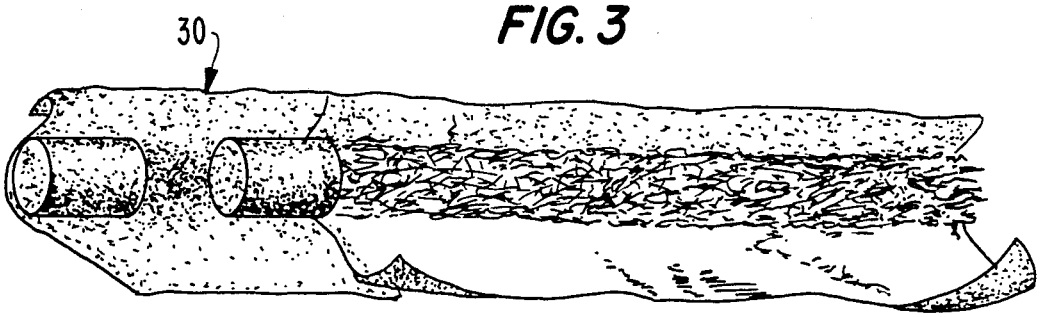
FIG. 3 is a perspective view of a second embodiment of the present invention.

One way of attaching the capsules to the cigarette paper according to one construction of the invention is that disclosed in U.S. Pat. No. 4,236,532 whose contents are accordingly hereby incorporated by reference in their entirety. The microencapsulated alcohols may be attached, in addition to the cigarette paper, to the plug wrap or contained in the filter of the cigarette either evenly disbursed or within the center of gravity of a triple gas trap filter construction, as shown generally at 30 in FIG. 3. Such a triple gas trap construction can have a plasticized containment system to minimize leakage from the ruptured capsules.

The capsules can be attached to the cigarette paper or plug wrap via a common gelatin or starch paste coating. The capsules may be mixed into the adhesive, and the paper may be coated via a processing through a slurry bath, similar to the method of attachment by carbonless paper. The capsules preferably are positioned in the filter section and not in the tobacco rod to mask any undesirable popping or crackling noises that may be associated with the release of the alcohol.

Figure 4:
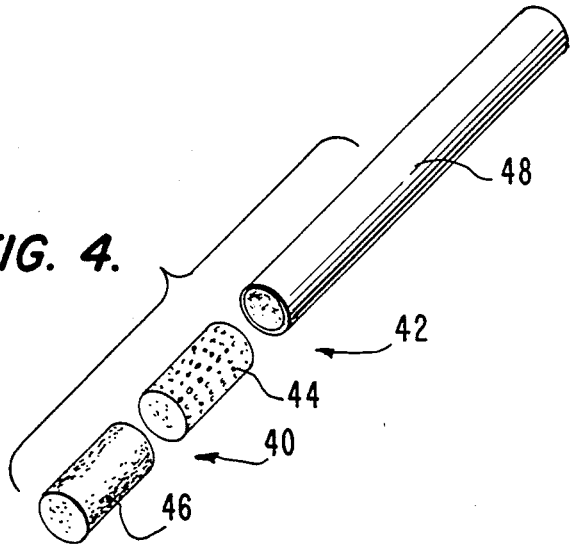
FIG. 4 is a perspective view of a third embodiment of the present invention.
Figure 5:
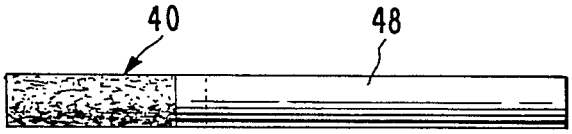
FIG. 5 is a side elevational view of the third embodiment.

Another delivery mechanism construction of the present invention is a twin filter plug, as illustrated in FIGS. 4 and 5. The twin plug filter section 40 of a cigarette shown generally at 42 is generally twenty to thirty mm in length with twenty-five mm being the most popular length. The twin filter plug 40 is used wherein a ten mm filter pack filter section 44 and a fifteen mm filter section 46 are placed end-to-end in the cigarette section. Each plug is encased in a separate plug wrap and the twin plugs are overwrapped by the plug wrap and then the tipping paper. The ten mm filter pack section 44 is placed against the tobacco rod 48 with the fifteen mm section disposed behind the ten mm section. The ten mm section 44 contains the encapsulated alcohols dispersed uniformly along its longitudinal axis. The capsules have a circumference and shell wall thickness as previously described. The shell wall release temperatures are preferably programmed, as previously mentioned, to be between sixty-five and six hundred and fifty degrees Fahrenheit to ensure a continuous release from the first lower temperature draw of the cigarette through the last draw thereof which is generally the hottest draw. Flavor enhancers may be added to the ten mm section 44 as part of the encapsulated material. As the smoke stream is drawn through the section 44, the capsule shell walls melt and the encapsulated alcohols are thereby released and then carried by the smoke stream into the section 46 which has a conventional cellulose acetate construction for ordinary filtration thereof before exiting the cigarette 42 into the smoker's respiratory system.

The filter pack section 44 can contain the encapsulated alcohols with the programmed shell walls, flavor reconstitutors, and Vitamin A or other additives as mentioned herein. An example of the inclusion of vitamins is that of U.S. Pat. No. 3,339,558 whose contents are hereby incorporated by reference in their entirety. Additional flavor enhancers may be added, if needed, to reconstitute the desired taste characteristics of the smoke after the smoke has absorbed the blocking compounds. Entirely incorporated herein by reference is U.S. Pat. No. 3,144,024 which illustrates the construction of a filter for use with smoking tobacco which is impregnated with a flavoring composition whose teachings can be used to design a device effecting the present invention. This filter section would preferably have all of these materials aligned on the longitudinal axis and dispersed radially therefrom.

It is also within the scope of this invention to add esters and alcohols without encapsulation or to process the alcohols with an ester It is further within the scope of this invention to impregnate the rag tobacco, rolling papers or smoking filters with the alcohols of this invention, and the alcohol vapor is thereby released and inhaled when the item is smoked. The paper wrapper can be dipped in the alcohol and then wrapped around the cigarette before the outer wrapper and foil of each pack is overwrapped. After a few weeks of storage the alcohol will diffuse into the cigarettes. This is a method similar to one used to place menthol in cigarettes, and is a very simple, relatively effective and inexpensive technique of the invention. It may also be that this impregnating embodiment would reduce the health concerns and risks of passive smoking.

Figure 6:
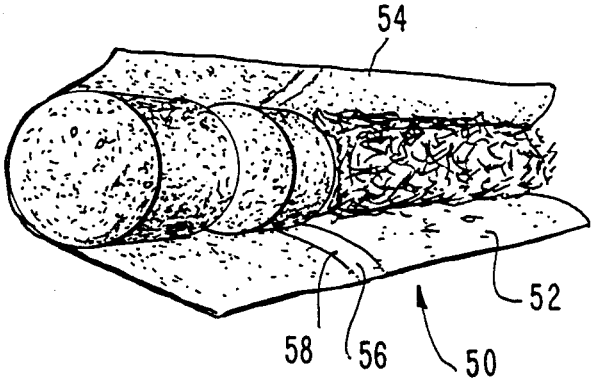
FIG. 6 is a perspective view of a fourth embodiment of the present invention.

As shown in FIG. 6, the microencapsulated alcohols can be coated or implanted in the cigarette 50 on the cigarette paper 52 in strips 54 or randomly throughout, and/or in the tipping paper 56 in strips 58 or randomly throughout the paper, and/or in the barrel wrap in strips or randomly throughout the paper. Alternatively or in combination therewith, as shown in FIG. 2, they can be positioned either randomly or in a predetermined pattern in the filter and/or the rag tobacco. Another method means is to spray the alcohol(s) as by an atomizer in the filter before smoking the cigarette.

Figure 7:
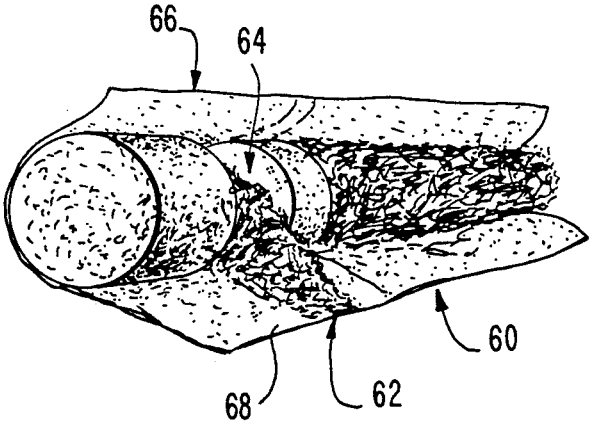
FIG. 7 is a perspective view of a fifth embodiment of the present invention.

Another mechanism for causing the alcohols to be delivered in the smoke stream of a cigarette 60 is to provide a double gas trap filter as best shown at 62 in FIG. 7. It is seen therein that the central cavity 64 of the filter 66 contains microencapsulated alcohols and/or crystalized alcohols and/or alcohol impregnated charcoals 68 such that the alcohol vapors are released when the cigarette 60 is smoked. The cavity 62 can also be lined with a membrane sufficient to prevent any leakage therefrom or moisture spoilage.

Figure 8:
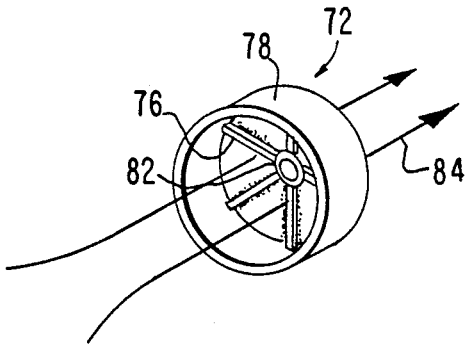
FIG. 8 is a perspective view of a key portion of a sixth embodiment of the present invention illustrated in isolation.
Figure 10:
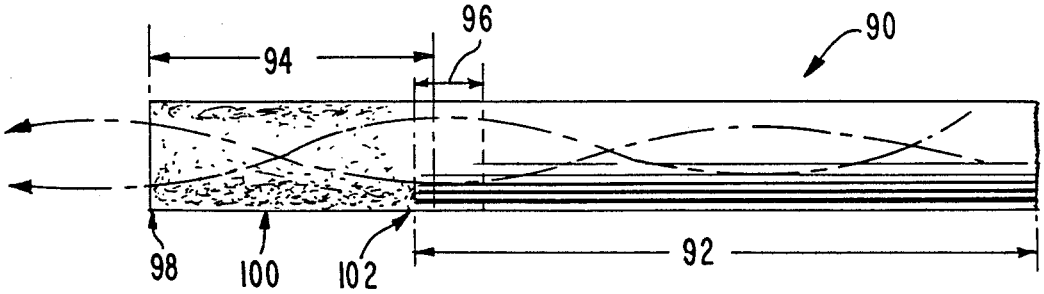
FIG. 10 is a perspective view of a cigarette illustrating the alternative locations for the sixth and seventh embodiments.

The microencapsulated alcohols can also be positioned in the cigarette 70 in a suspension device as shown generally at 72 in FIG. 8. The suspension device 72 comprises plastic spokes 76 secured to a rigid plastic hub 78 which is flush with the outside circumference of the cigarette barrel. The microencapsulated alcohols 82 are suspended on the spokes 76 and in the hub 78 and released into the smoke stream 84 when the cigarette is smoked. By way of further explanation a typical cigarette 90 including a tobacco rod 92, and adjacent filter 94 and overlapping tipping paper 96 is illustrated in FIG. 10. The suspension device 74 can be positioned at any of locations 98, 100 or 102 as denoted therein.

Figure 9:
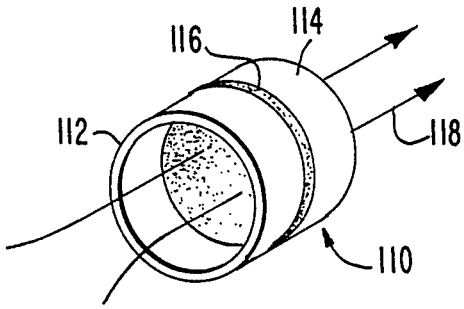
FIG. 9 is a perspective view of a key portion of a seventh embodiment of the present invention illustrated in isolation.

A suction release double trap 15 illustrated in isolation generally at 110 in FIG. 9 may also be inserted at any of locations 98, 100 or 102, of FIG. 10. The double trap 110 comprises a first trap 112, a second trap 114 and a rubberized membrane 116 dividing them. The first trap 112 contains the microencapsulated and/or crystalline alcohols, and is sealed on its tip side with the membrane 116. The membrane 116 when ruptured by suction releases the packing of contained alcohols into the second trap 114. The second trap comprises a plastic cell that contains the released alcohols, and provides a maximum surface exposure to the smoke stream 118 of the alcohols and also prevents their leakage from the cigarette.

It is also within the scope of this invention to place the alcohol containing elements anywhere inside the filter including via a large capsule placed inside the filter to be manually or automatically ruptured by other than heat means, as by piercing, squeezing or crushing. See, e.g., U.S. Pat. No. 3,547,130, hereby incorporated by reference in its entirety.

The alcohols of this invention can also be administered in a smoking pipe construction or special pipe tobacco formulation as would be apparent to one skilled in the art from this disclosure.

Additionally, there is no need to limit the present invention to alcohols which exist in the liquid state at ambient temperature. Alcohols which exist in the solid state at ambient temperature are also within the scope of the present invention. While it is unimportant whether the alcohols are administered as a solid or a liquid, it is important that the alcohols be administered in such a manner that the four aforementioned objectives are satisfied.

Another embodiment of the present invention is to incorporate these alcohols in a face mask so that the vapors thereof are released and inhaled by the wearer of the mask. This mask can be worn in polluted industrial environments or in environments where nitrosamines are present in the air.

A mouth spray device can be used to administer the alcohols by inhalation at will prior to exposure to any nitrosamines in the environment, as particularly those in the tobacco smoke stream. Hence, another embodiment contemplates a mouth spray or mist device having a cylindrical body (not shown) of plastic or metal which contains one or more alcohols of the present invention. A non-toxic carrier gas or propellant gas, such as compressed air or nitrogen, can also be used. When the alcohols of the present invention are administered by inhalation, a concentration of the alcohol in air of only about 0.001% is sufficient for purposes of delocalization nitrosamines in the respiratory epithelium. Incorporated herein by reference in their entirety are U.S. Pat. Nos. 4,016,279, 4,232,002 and 4,243,543.

From the foregoing detailed description, it will be evident that there are a number of changes, adaptations, and modifications of the present invention which come within the province of those persons skilled in the art. However, it is intended that all such variations not departing from the spirit of the invention be considered as within the scope thereof as limited solely by the claims appended hereto.

What is claimed is:

1. A tobacco smoking article comprising:

smoking tobacco;

a container in which said smoking tobacco is contained; and an alcohol supported by said container, said alcohol being associated with said smoking tobacco such that when said smoking tobacco is smoked the vapor of said alcohol is inhaled in the tobacco smoke stream, and said alcohol comprising cyclohexanol in an amount sufficient to inhibit the selective localization of nitrosamines and metabolites thereof in the tissues of the smoker of said smoking tobacco but not to produce any toxic side effects in the smoker who is inhaling the vapor thereof in the tobacco smoke stream.

2. The tobacco smoking article of claim 1 wherein said alcohol is encapsulated in shell walls.

3. The tobacco smoking article of claim 2 wherein said encapsulated alcohols are dispersed throughout said tobacco.

4. The tobacco smoking article of claim 2 wherein said shell walls are adapted to release said alcohol when heated to a temperature of between 64 and 650 degrees Fahrenheit.

5. The tobacco smoking article of claim 2 wherein said shell walls comprise between twenty and fifty percent of the volume of the encapsulated alcohol.

6. The tobacco smoking article of claim 2 wherein said container comprises cigarette paper, said encapsulated alcohol comprises a plurality of capsules of three to ten microns in circumference each, and said capsules are positioned on the inside of said cigarette paper or dispersed in said tobacco.

7. The tobacco smoking article of claim 2 wherein said container comprises at the proximal end thereof a cigarette filter, said encapsulated alcohol comprises at least one capsule of three to twenty or twenty-five microns, and said capsule is positioned in said cigarette filter.

8. The tobacco smoking article of claim 2 wherein said shell wall is formed of an ethylene/vinyl acetate copolymer or a similar cellulite material.

9. The tobacco smoking article of claim 2 wherein said shell wall is formed of a cationic copolymer synthesized from dimethylaminoethyl methacrylate and neutral methacrylic acid ester.

10. The tobacco smoking article of claim 2 wherein said shell wall is adapted to automatically release the alcohols encapsulated therein into the smoke stream when said tobacco is lighted and smoked.

11. The tobacco smoking article of claim 10 wherein said automatic release comprises a heat release.

12. The tobacco smoking article of claim 1 wherein said alcohol is dispersed throughout said tobacco.

13. The tobacco smoking article of claim 1 further comprising said container comprising cigarette paper in an elongated configuration and containing said tobacco therein to thereby form a tobacco rod, a filter connected to the proximal end of said tobacco rod, and a filter pack containing said alcohol and disposed between said filter and said tobacco rod.

14. The tobacco smoking article of claim 13 wherein said alcohol is encapsulated in a plurality of capsules formed by a heat-rupturable shell wall.

15. The tobacco smoking article of claim 14 wherein said capsules are configured, adapted, and positioned to provide for a continuous release of said alcohol in the smoke stream during generally the entire period of smoking of said tobacco rod.

16. The tobacco smoking article of claim 13 further comprising flavor enhancers disposed in said filter pack.

17. The tobacco smoking article of claim 13 wherein said filter pack is about ten millimeters long.

18. The tobacco smoking article of claim 13 wherein said filter comprises a cellulose acetate filter.

19. The tobacco smoking article of claim 1 further comprising said container comprising cigarette paper in an elongated configuration and containing said tobacco therein to thereby form a tobacco rod having a rod end, and a cellulose acetate filter secured to said rod end.

20. The tobacco smoking article of claim 1 wherein said tissues include bronchial epithelium tissue.

21. The tobacco smoking article of claim 1 wherein said tissues include salivary duct epithelium tissue.

22. The tobacco smoking article of claim 1 wherein said tissues include liver tissue.

23. The tobacco smoking article of claim 1 further comprising at least one vitamin in said container.

24. The tobacco smoking article of claim 23 wherein said vitamin is selected from the group of Vitamins A, B, C, and E.

25. The tobacco smoking article of claim 1 wherein said nitrosamines are NNN, NPYR, or NNK.

26. The tobacco smoking article of claim 1 further comprising at least one rupturable capsule containing said alcohol and supported by said container.

27. The tobacco smoking article of claim 26 wherein said rupturable capsule is adapted to be manually rupturable.

28. The tobacco smoking article of claim 27 wherein said container includes a filter at the proximal end thereof and said rupturable capsule is positioned in said filter.

29. The tobacco smoking article of claim 26 wherein said container includes a filter at the proximal end thereof and said rupturable capsule is positioned in said filter.

30. A method for inhibiting the selective localization of nitrosamines and metabolites thereof present in tobacco smoke in mammalian tissues, said method comprising:

administering alcohol to a mammal, said alcohol comprising cyclohexanol, and said administering being by the mammal inhaling a vapor of said cyclohexanol alcohol in a tobacco smoke stream in an amount sufficient to inhibit the selective localization of nitrosamines and metabolites thereof in the tissues of the mammal but not to produce any toxic side effects in the mammal.

31. The method of claim 30 wherein said tissues include bronchial epithelium tissue.

32. The method of claim 30 wherein said tissues include salivary duct epithelium tissue.

33. The method of claim 30 wherein said tissues include liver tissue.

34. The method of claim 30 wherein said administering is conducted irrespective of the presence of tumors on said tissues.

35. The method of claim 30 wherein said inhaling includes inhaling the vapor of at least one vitamin.

36. The method of claim 35 wherein said vitamin is selected from the group of Vitamins A, B, C, and E.

37. The method of claim 30 wherein said nitrosamines are NNN, NPYR, or NNK.

38. The method of claim 30 further comprising filtering the alcohol laden smoke stream before said inhaling step.

39. A tobacco smoking article comprising:

smoking tobacco;

an alcohol supported by said container, said alcohol being associated with said smoking tobacco such that when said smoking tobacco is smoked the vapor of said alcohol is inhaled in the tobacco smoke stream, and said alcohol comprising t-butanol in an amount sufficient to inhibit the selective localization of nitrosamines and metabolites thereof in the tissue of the smoker of said smoking tobacco but not to produce any toxic effects in the smoker who is inhaling the vapor thereof in the tobacco smoke stream.

40. The tobacco smoking article of claim 39 wherein said alcohol is encapsulated in shell walls.

41. The tobacco smoking article of claim 40 wherein said encapsulated alcohols are dispersed throughout said tobacco.

42. The tobacco smoking article of claim 40 wherein said shell walls are adapted to release said alcohol when heated to a temperature of between 64 and 650 degrees Fahrenheit.

43. The tobacco smoking article of claim 40 wherein said shell walls comprise between twenty and fifty percent of the volume of the encapsulated alcohol.

44. The tobacco smoking article of claim 40 wherein said container comprises cigarette paper, said encapsulated alcohol comprises a plurality of capsules of three to ten microns in circumference each, and said capsules are positioned on the inside of said cigarette paper or dispersed in said tobacco.

45. The tobacco smoking article of claim 40 wherein said container comprises at the proximal end thereof a cigarette filter, said encapsulated alcohol comprises at least one capsule of three to twenty or twenty-five microns, and said capsule is positioned in said cigarette filter.

46. The tobacco smoking article of claim 40 wherein said shell wall is formed of an ethylene/vinyl acetate copolymer or a similar cellulite material.

47. The tobacco smoking article of claim 40 wherein said shell wall is formed of a cationic copolymer synthesized from dimethylaminoethyl methacrylate and neutral methacrylic acid ester.

48. The tobacco smoking article of claim 40 wherein said shell wall is adapted to automatically release the alcohols encapsulated therein into the smoke stream when said tobacco is lighted and smoked.

49. The tobacco smoking article of claim 48 wherein said automatic release comprises a heat release.

50. The tobacco smoking article of claim 39 wherein said alcohol is dispersed throughout said tobacco.

51. The tobacco smoking article of claim 39 further comprising said container comprising cigarette paper in an elongated configuration and containing said tobacco therein to thereby form a tobacco rod, a filter connected to the proximal end of said tobacco rod, and a filter pack containing said alcohol and disposed between said filter and said tobacco rod.

52. The tobacco smoking article of claim 51 wherein said alcohol is encapsulated in a plurality of capsules formed by a heat-rupturable shell wall.

53. The tobacco smoking article of claim 52 wherein said capsules are configured, adapted, and positioned to provide for a continuous release of said alcohol in the smoke stream during generally the entire period of smoking of said tobacco rod.

54. The tobacco smoking article of claim 51 further comprising flavor enhancers disposed in said filter pack.

55. The tobacco smoking article of claim 51 wherein said filter pack is about ten millimeters long.

56. The tobacco smoking article of claim 51 wherein said filter comprises a cellulose acetate filter.

57. The tobacco smoking article of claim 39 further comprising said container comprising cigarette paper in an elongated configuration and containing said tobacco therein to thereby form a tobacco rod having a rod end, and a cellulose acetate filter secured to said rod end.

58. The tobacco smoking article of claim 39 wherein said tissues include bronchial epithelium tissue.

59. The tobacco smoking article of claim 39 wherein said tissues include salivary duct epithelium tissue.

60. The tobacco smoking article of claim 39 wherein said tissues include liver tissue.

61. The tobacco smoking article of claim 39 further comprising at least one vitamin in said container.

62. The tobacco smoking article of claim 61 wherein said vitamin is selected from the group of Vitamins A, B, C, and E.

63. The tobacco smoking article of claim 39 wherein said nitrosamines are NNN, NPYR, or NNK.

64. The tobacco smoking article of claim 39 further comprising at least one rupturable capsule containing said alcohol and supported by said container.

65. The tobacco smoking article of claim 64 wherein said rupturable capsule is adapted to be manually rupturable.

66. The tobacco smoking article of claim 65 wherein said container includes a filter at the proximal end thereof and said rupturable capsule is positioned in said filter.

67. The tobacco smoking article of claim 64 wherein said container includes a filter at the proximal end thereof and said rupturable capsule is positioned in said filter.

68. A method for inhibiting the selective localization of nitrosamines and metabolites thereof present in tobacco smoke in mammalian tissues, said method comprising:

administering alcohol to a mammal, said alcohol comprising t-butanol, and said administering being by the mammal inhaling a vapor of said t-butanol alcohol in the tobacco smoke stream in an amount sufficient to inhibit the selective localization of nitrosamines and metabolites thereof in the tissues of the mammal but not to produce any toxic side effects in the mammal.

69. The method of claim 68 wherein said tissues include bronchial epithelium tissue.

70. The method of claim 68 wherein said tissues include salivary duct epithelium tissue.

71. The method of claim 68 wherein said tissues include liver tissue.

72. The method of claim 68 wherein said administering is conducted irrespective of the presence of tumors on said tissues.

73. The method of claim 68 wherein said inhaling includes inhaling the vapor of at least one vitamin.

74. The method of claim 73 wherein said vitamin is selected from the group of Vitamins A, B, C, and E.

75. The method of claim 68 wherein said nitrosamines are NNN, NPYR, or NNK.

76. The method of claim 68 further comprising filtering the alcohol-laden smoke stream before said inhaling step.

* * * * *